US006149119A

United States Patent [19]

O'Connell

[11] Patent Number: 6,149,119

[45] Date of Patent: Nov. 21, 2000

[54] DEVICE FOR PROVIDING STABILITY TO A UTENSIL

[76] Inventor: Andrew Mark O'Connell, 114 Jeddo Road, London W12 9EG, United Kingdom

[21] Appl. No.: 08/915,965

[22] Filed: Aug. 21, 1997

[30] Foreign Application Priority Data

Aug. 21, 1996 [GB] United Kingdom ..... 9617492

[51] Int. Cl.[7] ..... F16M 13/00

[52] U.S. Cl. ..... 248/545; 248/156; 248/146; 248/530

[58] Field of Search ..... 47/39; 248/87, 248/530, 533, 146, 150, 156, 532, 346.01, 545, 151, 205.2, 205.3, 205.9, 206.2, 206.5, 346.03, 346.04, 346.06

[56] References Cited

U.S. PATENT DOCUMENTS

| | | | |
|---|---|---|---|
| 1,448,808 | 3/1923 | McGowan | 47/41.01 |
| 1,739,702 | 12/1929 | Wing | 248/96 |
| 1,874,185 | 8/1932 | Goldstein | 47/41.01 |
| 1,876,322 | 9/1932 | Rudolph | 248/146 |
| 2,482,278 | 9/1949 | Koerner | 248/156 |
| 4,071,062 | 1/1978 | Ianette | 150/1.5 B |
| 4,420,158 | 12/1983 | Klock | 273/400 |
| 4,659,049 | 4/1987 | Watson | 248/346.1 |
| 4,927,118 | 5/1990 | Pierorazio | 248/545 |
| 4,928,876 | 5/1990 | Marshall | 229/103.1 |
| 4,946,118 | 8/1990 | Hastings | 248/97 |
| 5,044,597 | 9/1991 | Walczak | 248/530 |
| 5,161,561 | 11/1992 | Jamieson | 135/16 |
| 5,199,361 | 4/1993 | Robinson | 109/51 |
| 5,222,703 | 6/1993 | Ricciardelli | 248/96 |
| 5,402,907 | 4/1995 | Liu . | |
| 5,526,773 | 6/1996 | Richardson | 119/51.5 |

FOREIGN PATENT DOCUMENTS

| | | |
|---|---|---|
| 0 069 042 | 1/1983 | European Pat. Off. . |
| 0 400 358 | 12/1990 | European Pat. Off. . |
| 685101 | 12/1952 | United Kingdom . |
| 2 204 119 | 11/1988 | United Kingdom . |
| 2 277 019 | 10/1994 | United Kingdom . |
| 95/10202 | 4/1995 | WIPO . |

*Primary Examiner*—Ramon O. Ramirez
*Assistant Examiner*—Gwendolyn Baxter
*Attorney, Agent, or Firm*—Alston & Bird LLP

[57] ABSTRACT

A device for providing stability to a utensil (1) comprises an elongate spigot (5) arranged to be inserted into an apertured support or the ground, and a retaining member (4) arranged to be secured to, or formed on, the base (2) of the utensil (1). The spigot (5) is releasably retainable by the retaining member (4) in either a first position in which the longitudinal axis (14) of the spigot (5) is generally perpendicular to the base (2) of the utensil (1) so as to enable the spigot (5) to be inserted into the apertured support or in the ground, or a second position in which the longitudinal axis (14) of the spigot (5) is substantially parallel to the base (2) so as to store the spigot (5) when not in use.

9 Claims, 13 Drawing Sheets

DEVICE FOR PROVIDING STABILITY TO A UTENSIL

TECHNICAL FIELD

The present invention relates to a device for providing stability to a utensil, the utensil being, for example, any vessel, container or apparatus used to contain, store or hold materials, such as foodstuffs, liquids, candles, plants, ornaments or any other suitable products.

BACKGROUND OF THE INVENTION

Most utensils of the type mentioned above have either a flat or otherwise shaped base which needs to be placed on a flat or correspondingly shaped surface so that the utensil can retain a stable, balanced and generally upright position. However, there are many locations in which a suitable surface upon which a utensil can be stably placed may not be available, for example outdoors in the garden, picnic areas or on the beach; in the swimming pool or the sea; or on a boat; or in a vehicle such as a motor car, coach, aircraft or train; or even indoors in the home, office or a hotel.

In order to mitigate this problem, it is known to provide a base of an object with a spiked attachment which can be inserted, for example, in the ground. However, the spike is either permanently attached to the base of the object, in which case the object cannot be stably placed on a flat surface, or the spike is detachable from the object and is then inverted and stored in an interior space of the object, in which case the object needs to be specifically designed to accommodate the unused spike.

It is an object of the present invention to provide an improved device for providing stability to a utensil.

SUMMARY OF THE INVENTION

According to a first aspect of the invention, there is provided a device for providing stability to a utensil, said device comprising an elongate member arranged to be inserted into an aperture of a support or the ground, and a member arranged to be secured to, or formed on, a surface of said utensil and to releasably retain said elongate member, characterised in that said elongate member is releasably retainable by said retaining member in either a first position in which the longitudinal axis of said elongate member is substantially perpendicular to said surface so as to enable said elongate member to be inserted into said aperture of said support or the ground, or a second position in which the longitudinal axis of said elongate member is substantially parallel to said surface so as to store said elongate member when said device is not in use.

Preferably, the elongate member is provided with an elongate portion and an end portion, the end portion being shaped so as to engage with the retaining member when the retaining member is in said first position. In one example, the end portion and the retaining member are formed with interengageable screw threads. The retaining member may have one or more walls extending generally perpendicular to the utensil surface and in which one or more apertures or recesses are formed for receiving the elongate portion when the elongate member is in the second position.

Alternatively, the retaining member may be shaped to form a slot into which the end portion of the elongate member slidably engages when the elongate member is in said first position and into which the elongate portion of the elongate member slidably engages when the elongate member is in said second position.

In a preferred arrangement, the retaining member is surrounded by a skirt within which the elongate member is contained when in said second position, In one particular example, the retaining member is formed on a base of the utensil and the skirt depends from the base.

According to a second aspect of the invention, there is provided an assembly for providing stability to a utensil, said assembly comprising a device, as hereinabove described, and a support having one or more apertures for receiving the elongate member when in said first position. The support may be provided with means for releasable attachment to a stable surface or object.

According to a third aspect of the invention, there is provided a utensil having a device, as hereinabove described, the utensil comprising a vessel having one or more side walls and/or a base containing a coolant.

BRIEF DESCRIPTION OF THE DRAWINGS

The invention will now be described by way of example with reference to the accompanying drawings, in which.

DETAILED DESCRIPTION OF THE PREFERRED EMBODIMENTS

Figure 1C:
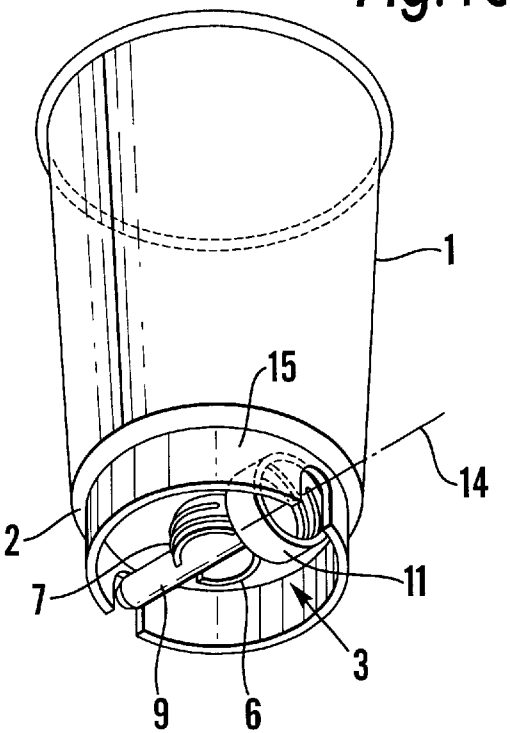
FIGS. 1*a* to 1*c* show perspective views of one embodiment of the present invention.
Figure 1B:
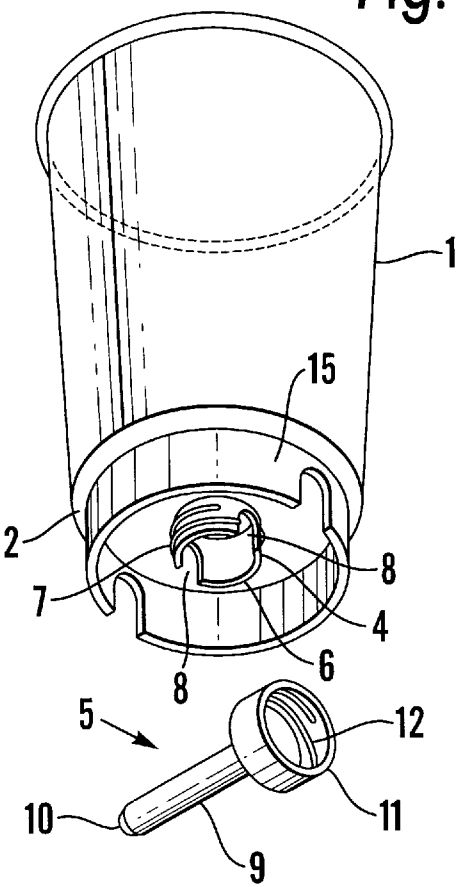
Figure 1A:
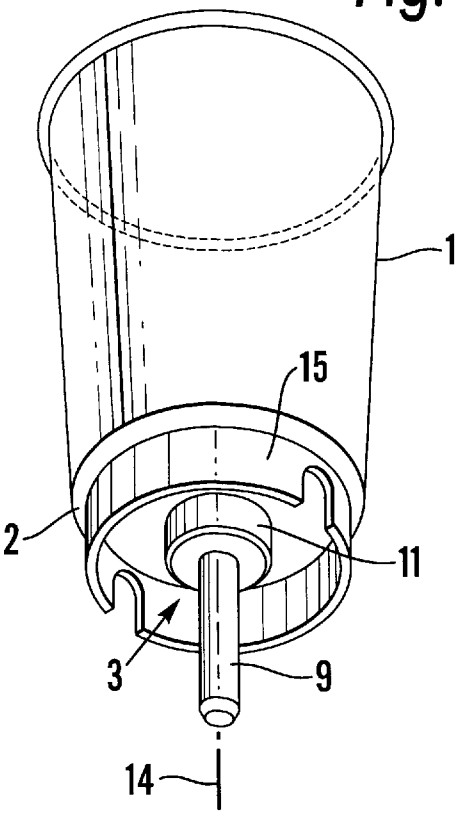

Referring first to FIGS. 1*a* to 1*c*, a utensil in the form of a drinking vessel 1 has a base 2 upon which a device 3 for providing stability thereto is provided. The device 3 comprises a retaining member 4 provided on the centre of the base 2 and an elongate spigot 5. The retaining member 4 has an annular wall 6 with screw thread 7 formed on its external surface and apertures or recesses 8 formed in the lower edge of the wall. The spigot 5 comprises an elongate portion 9 with a rounded end 10 and an annular end portion 11 provided with an internal screw thread 12 arranged to engage with screw thread 7.

FIG. 1*a* shows the stabilising device in its use position in which longitudinal axis 14 of the spigot 5 is generally perpendicular to the base 2. In this position, the spigot 5 is screwed to the retaining member 4 and can be inserted into the ground or any suitable apertured support as will be described in more detail hereinbelow.

In FIG. 1*b*, the spigot 5 has been unscrewed from the retaining member 4 and turned through 90° so that its longitudinal axis 14 is generally parallel to the base 2.

In FIG. 1*c*, the spigot 5 is then inserted into and retained by the recesses 8, where it can be stored until it is next required to stabilise the vessel 1.

The vessel 1 is formed with an annular, downwardly-depending skirt 15 around the periphery of the base 2, within which the spigot 5 is contained when not in use. By this arrangement, the vessel 1 can still be stably placed on a flat surface, if required.

Figure 2A:
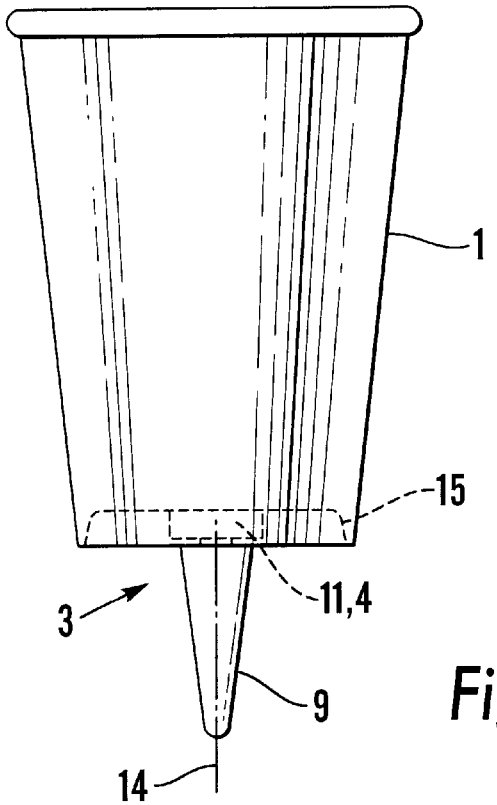
FIGS. 2*a* to 2*c* show views of a second embodiment.
Figure 2B:
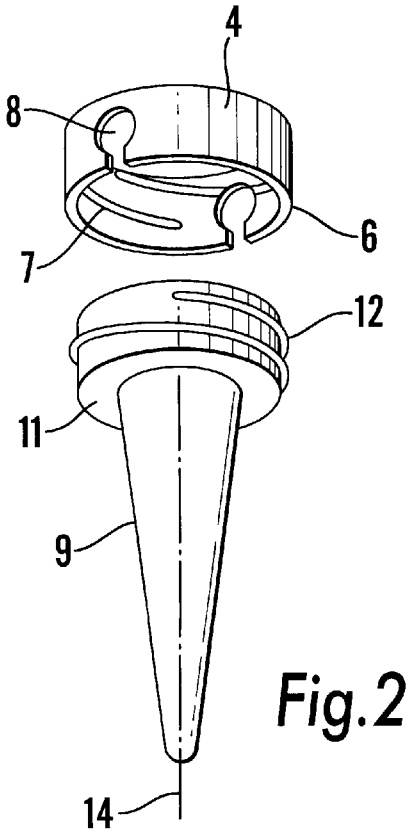
Figure 2C:
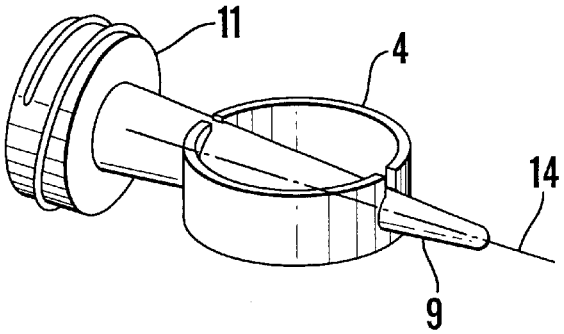

FIGS. 2*a* to 2*c* show a second embodiment, in which like parts have been labelled with like reference numerals with respect to FIGS. 1*a* to 1*c*. In this second embodiment, the screw threads 7 and 12 are formed respectively on the internal surface of the annular wall 6 of the retaining member 4 and on the external surface of the end portion 11 of the spigot 5. Additionally, the elongate portion 9 of the spigot 5 is a conical shape.

Figure 3A:
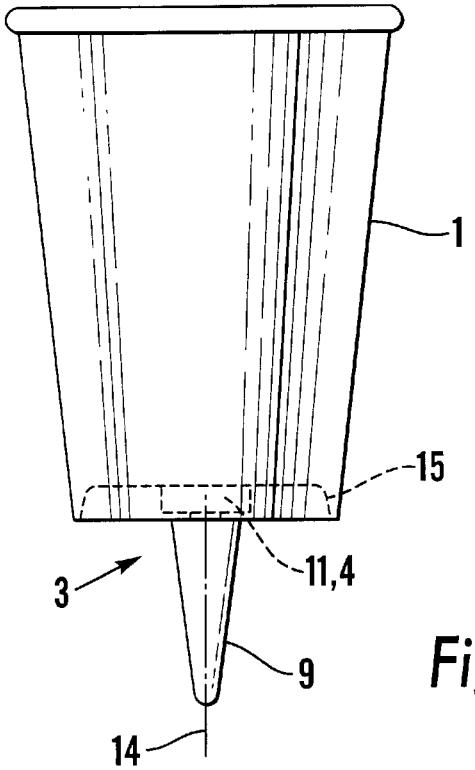
FIGS. 3*a* to 3*c* show views of a third embodiment.
Figure 3B:
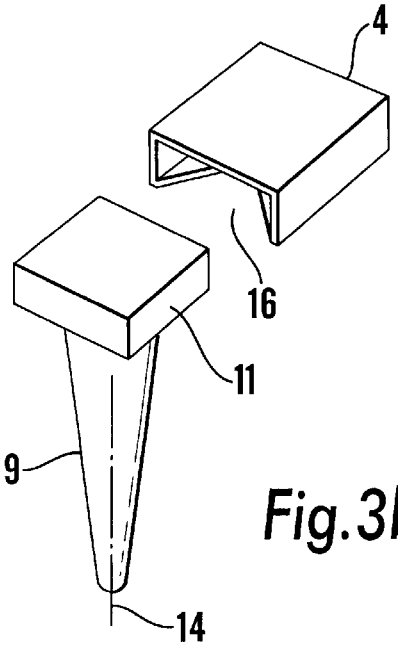
Figure 3C:
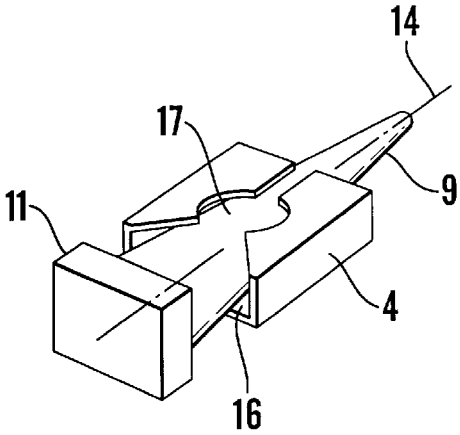
Figure 4A:
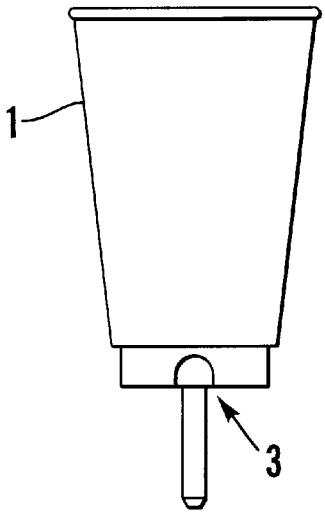
FIGS. 4*a* to 4*d* show side views of different examples of a utensil for which the invention can be used.
Figure 4B:
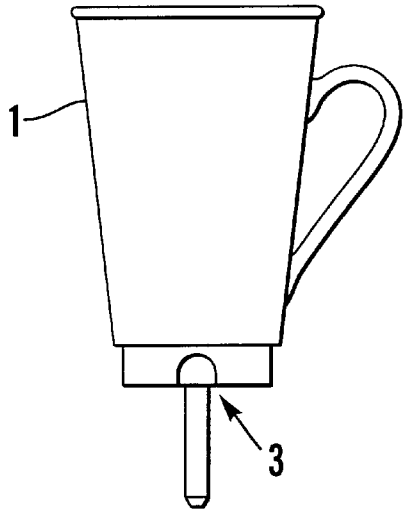
Figure 4C:
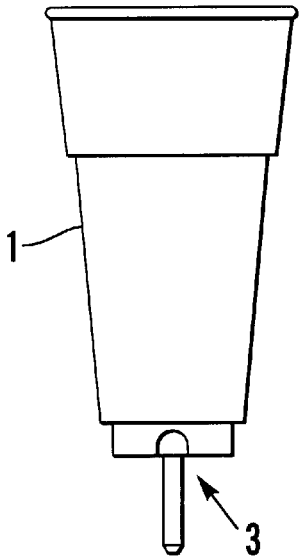
Figure 4D:
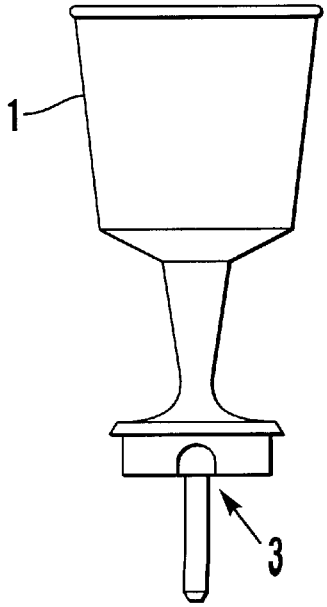

FIGS. 3*a* to 3*c* show a third embodiment, again in which like parts have been labelled with like reference numerals with respect to FIGS. 1*a* to 1*c*. In this third embodiment, the retaining member 4 is shaped so as to form a slot or channel 16 open on its underside so as to form an aperture 17. The end portion 11 of the spigot 5 is a rectangular-shaped block which slidably engages in the channel 16 with the elongate portion 9 extending through the aperture 17 in the retaining member 4, when the device is in use. When the stabilising device is not required, the elongate portion 9 slidably engages in the channel 16, as shown in FIG. 3*c*.

FIGS. 4*a* to 4*d* show four different designs of drinking vessel to which the stabilising device could be applied, that is, a vessel with or without a handle, one having different diameters, and a stemmed type.

FIGS. 5 to 12 show different examples of a support which can be used, together with the stabilising device, to provide the required stability, depending on the individual conditions of the location where the vessel is required to be used. In each example shown in FIGS. 5 to 10 and 12, the Figure referenced "a" shows the component parts and the Figure referenced "b" shows the example in use. In these FIGS. 5 to 12, like parts are also labelled with like reference numerals.

Figure 5A:
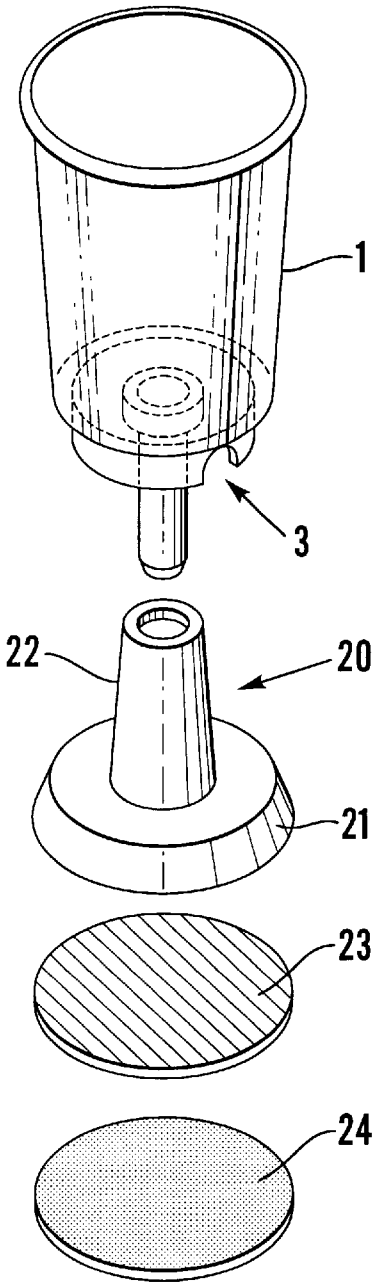
FIGS. 5 to 12*b* show examples of various types of support which can be used with the present invention.
Figure 5B:
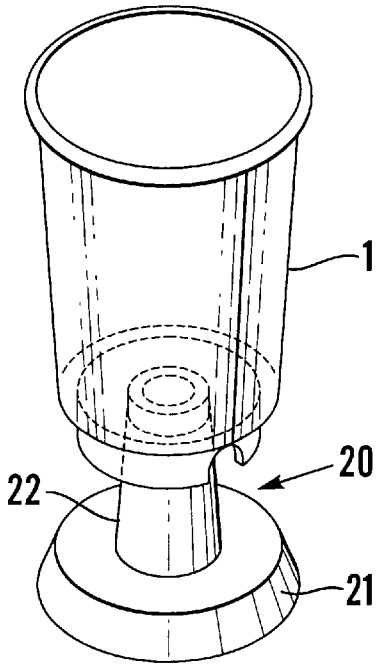

Referring now to FIGS. 5*a* and 5*b*, the support 20 comprises a base 21 and an upstanding hollow part 22 into which the elongate portion 9 is inserted for stability. On the underside of the base 21, a first Velcro pad 23 can be secured, by adhesive or any other means, and a second Velcro pad 24, which co-operates with pad 23, can be secured to any appropriate surface. Alternatively, just the first Velcro pad 23 secured to the base 21 can be attached directly to soft furnishing materials to provide a secure fixing.

Figure 6A:
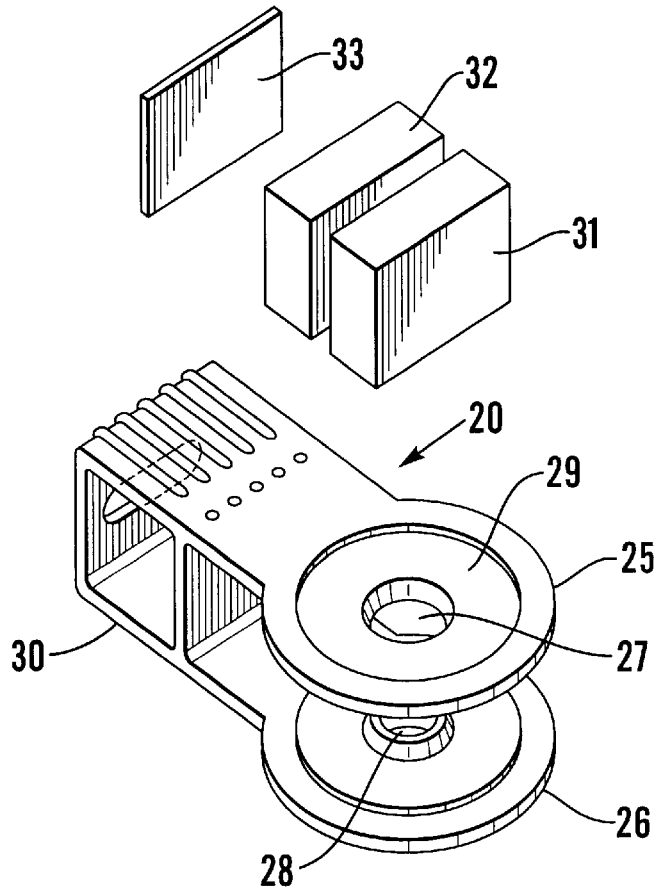
Figure 6B:
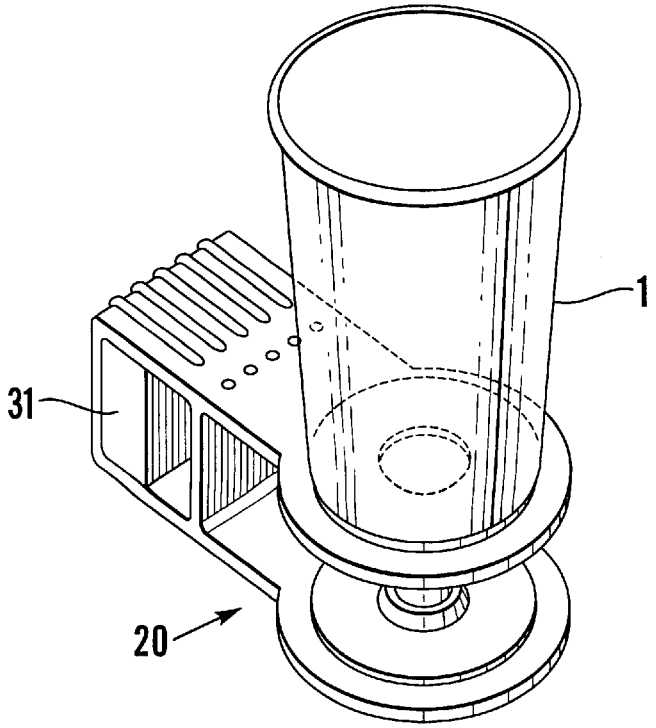

In FIGS. 6*a* and 6*b*, the support 20 comprises two spaced-apart circular members 25, 26 having aligning apertures 27, 28 in the centres thereof and the upper member 25 has a circular indentation 29 in its upper surface to retain the base of the vessel 1. The circular members 25, 26 are formed with an attachment part 30 containing a magnet 31, which can either be directly attached to a metallic surface, such as a fridge, or can be attached to another magnet 32 which may be secured to another surface by, for example, double-sided tape 33.

Figure 7A:
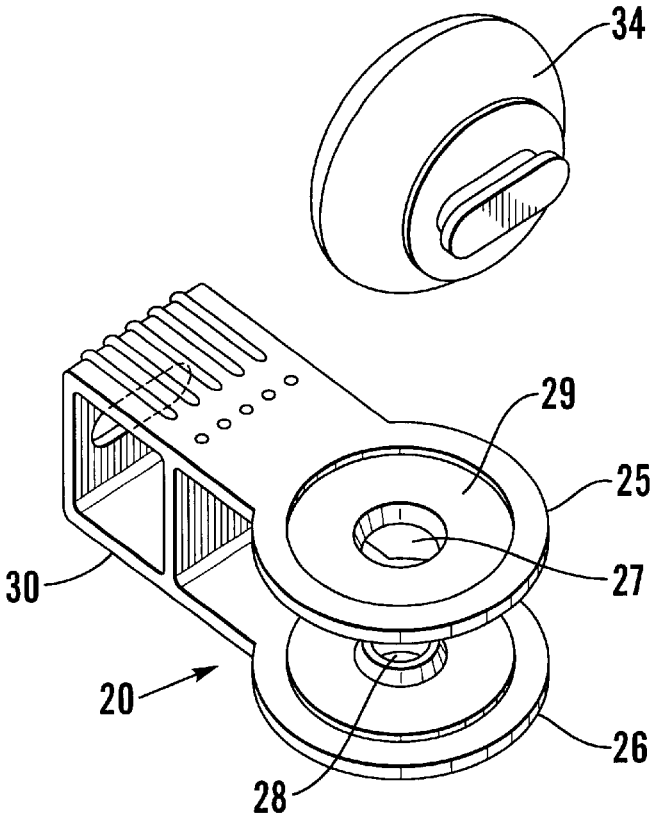
Figure 7B:
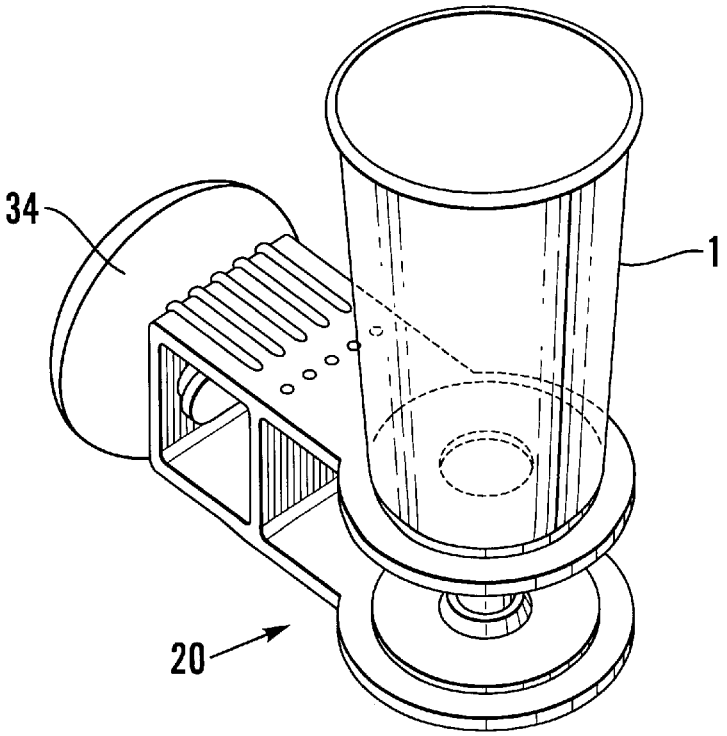

In FIGS. 7*a* and 7*b*, a suction pad 34 may be secured to the attachment part 30 and the suction pad can be stuck to any suitable surface.

Figure 8A:
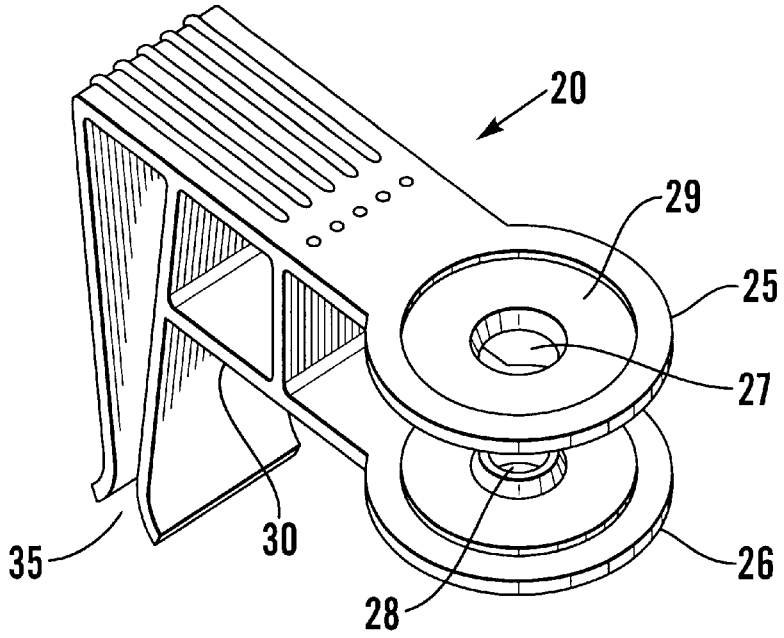
Figure 8B:
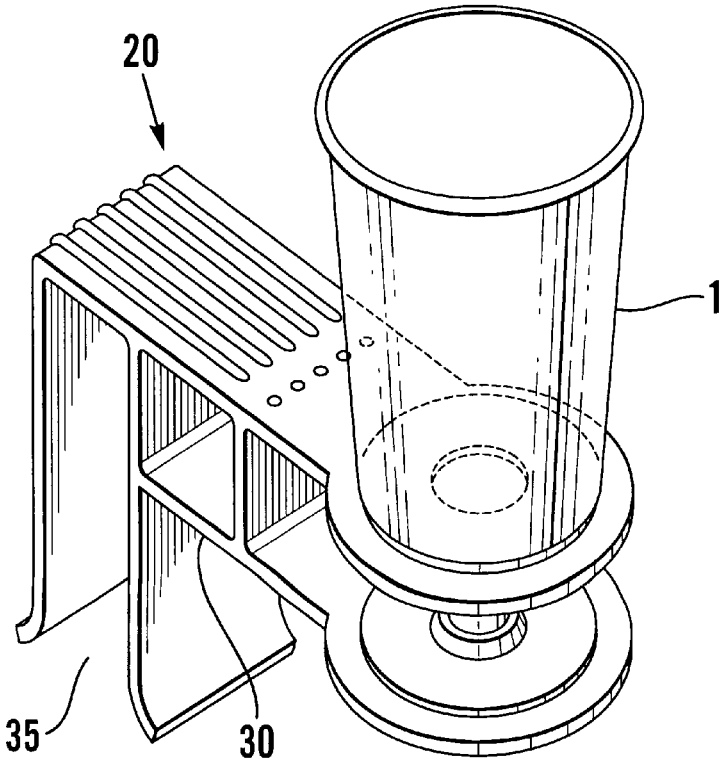

In FIGS. 8*a* and 8*b*, the attachment part 30 is formed with a spring clip 35, the opening part of which is directed downwards, so that the support 20 can be secured to the top edge of any vertical surface, such as a chair back, fence, etc.

Figure 9A:
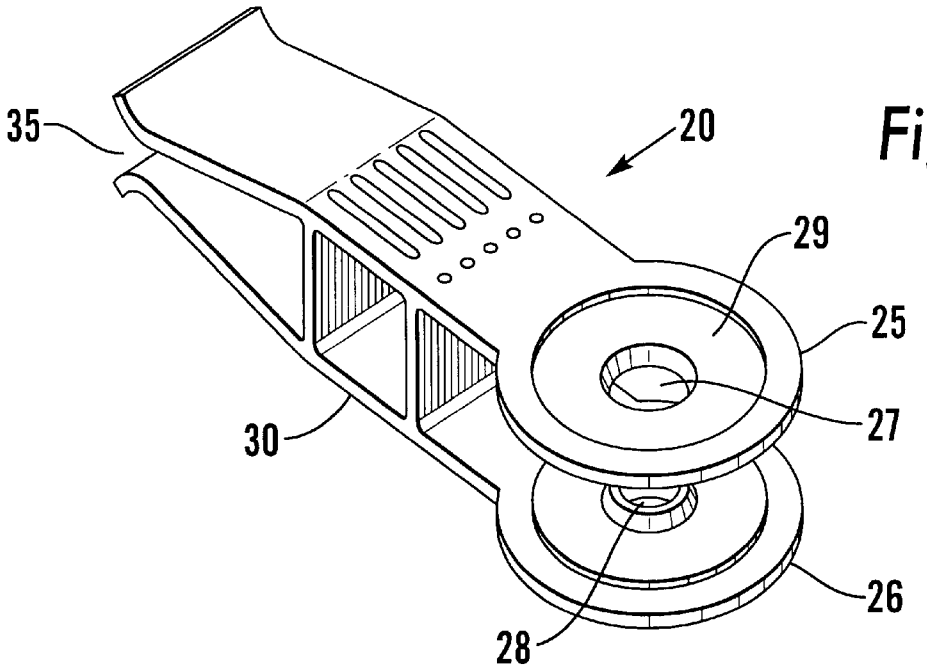
Figure 9B:
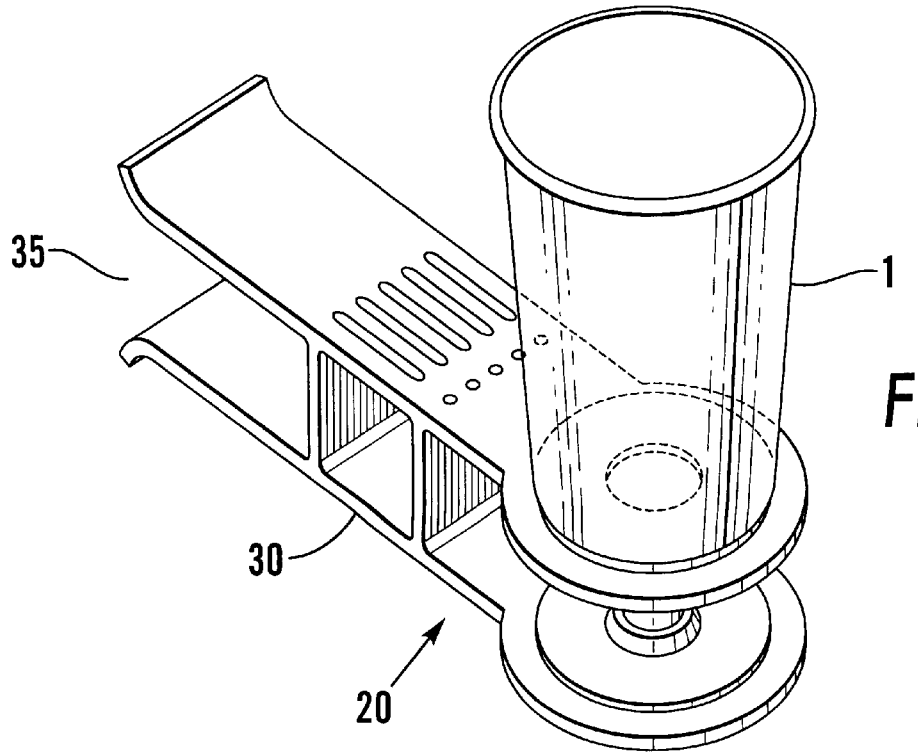

In FIGS. 9*a* and 9*b*, the spring clip 35 opens in a horizontal direction so that the support 20 can be secured to the edge of a horizontal surface, such as a table, chair seat, etc.

Figure 10A:
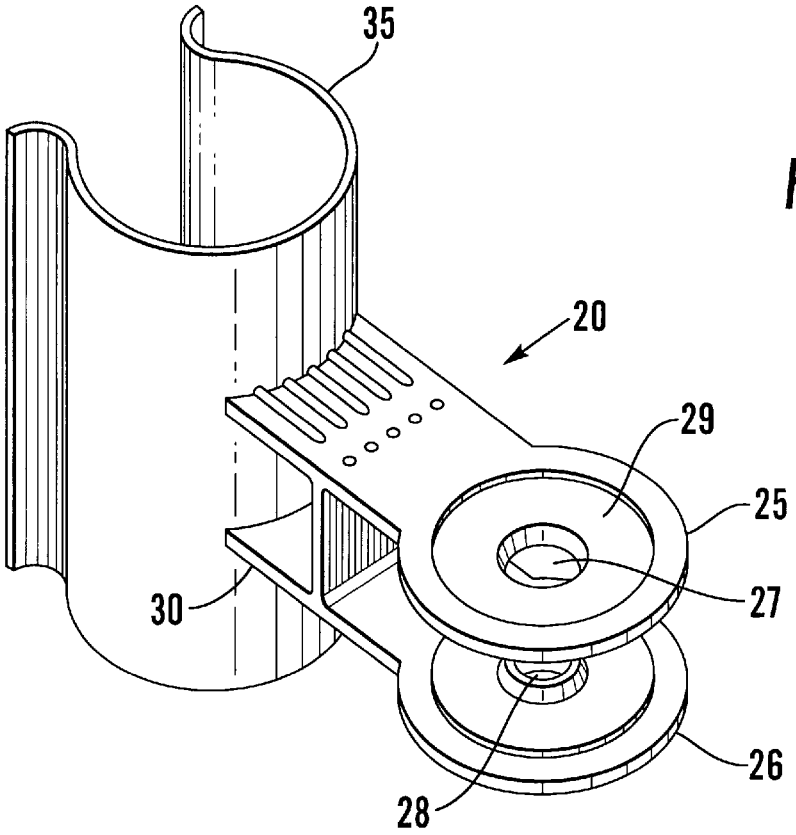
Figure 10B:
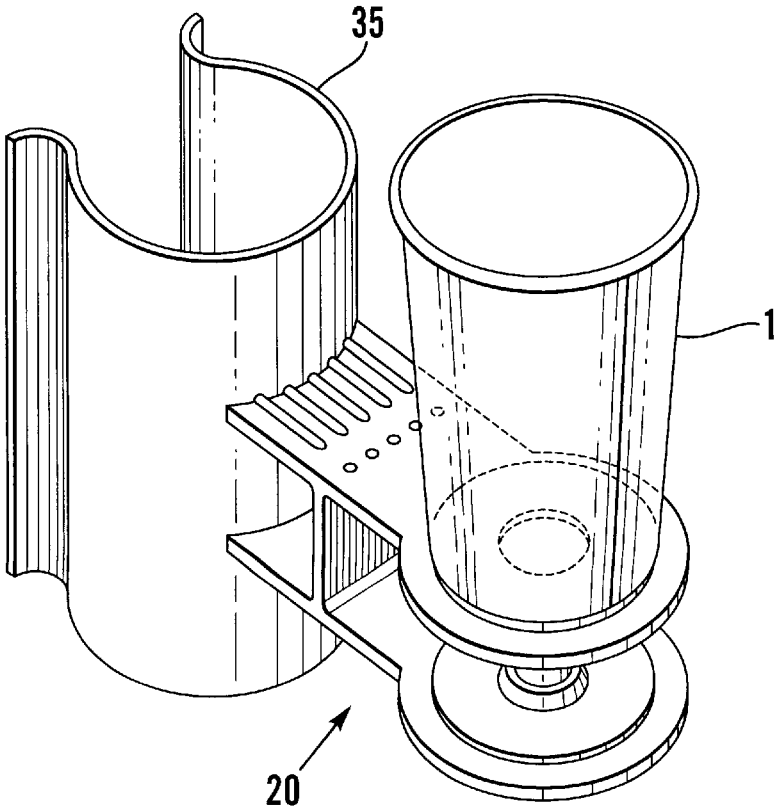

In FIGS. 10*a* and 10*b*, the spring clip 35 is a part-annular configuration, so as to grip around a vertical pole. Alternatively, the clip 35 could be turned through 90° so as to grip a horizontal pole.

Figure 11:
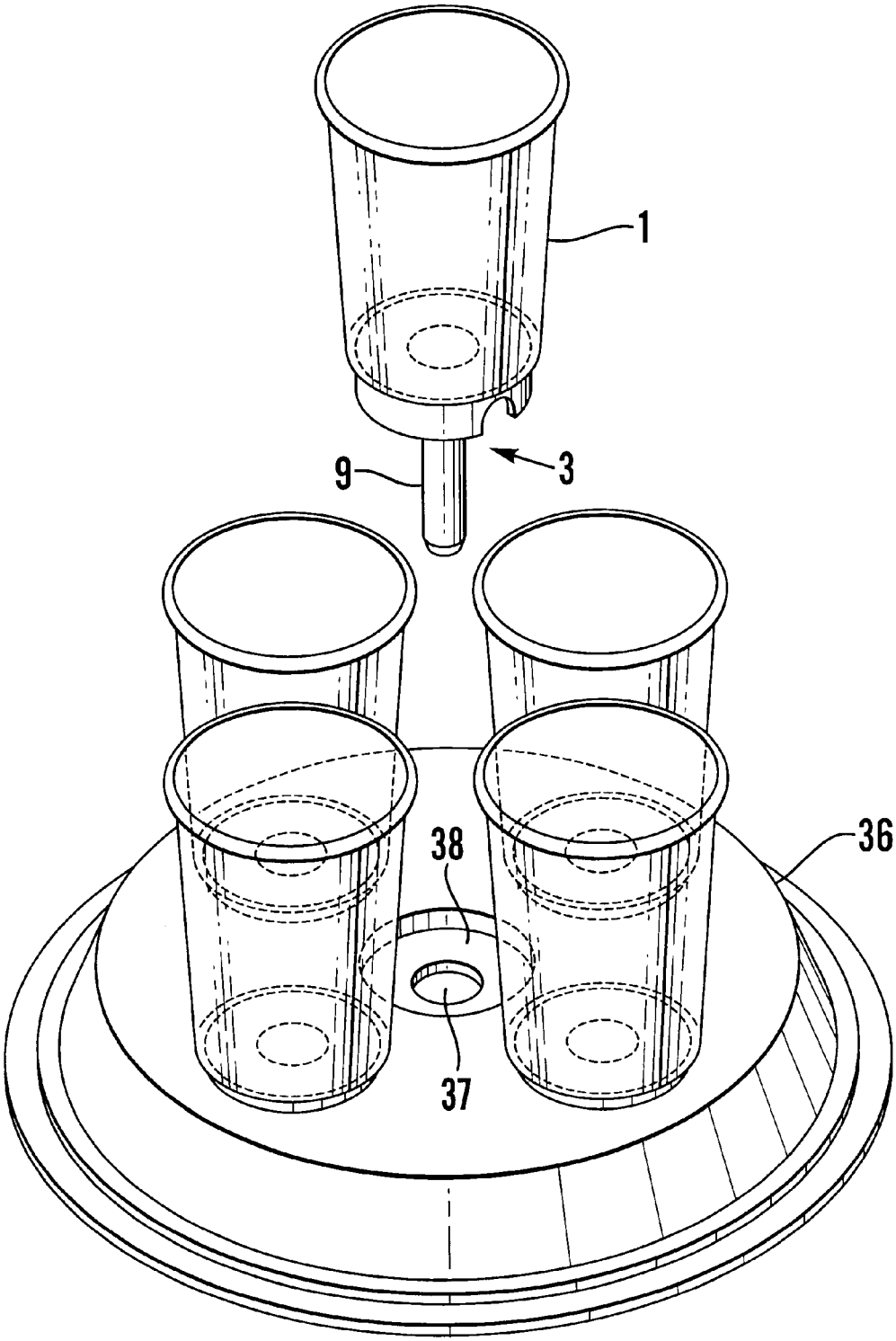

In FIG. 11, the support is in the form of a tray 36 having a plurality of apertures 37, into which the elongate portion 9 of the spigot 5 is inserted and around which indentations 38 are formed to retain the base of the vessel 1.

Figure 12A:
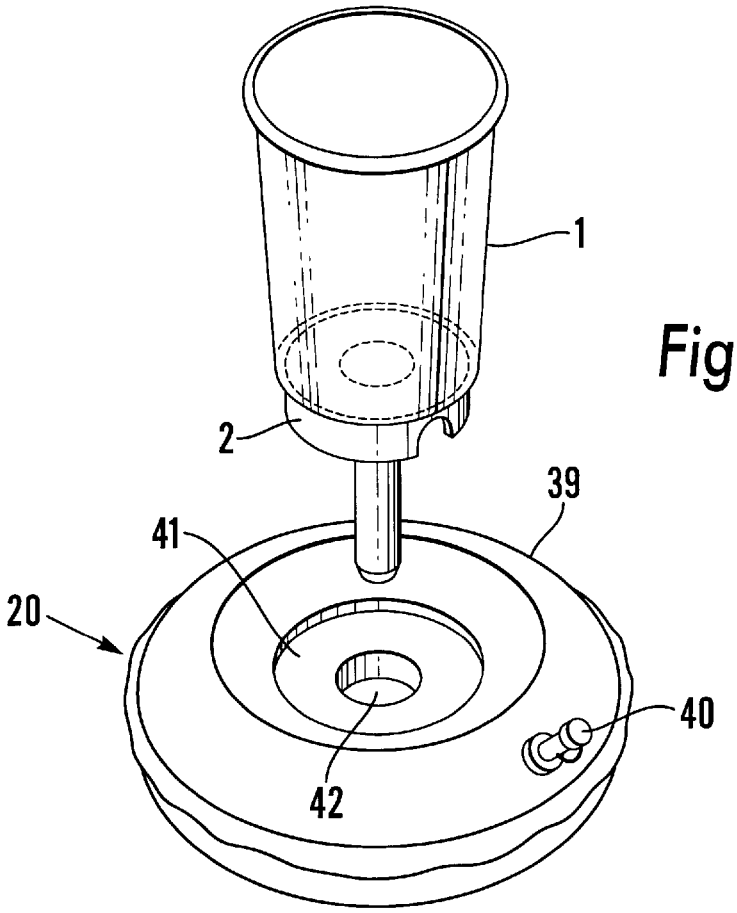
Figure 12B:
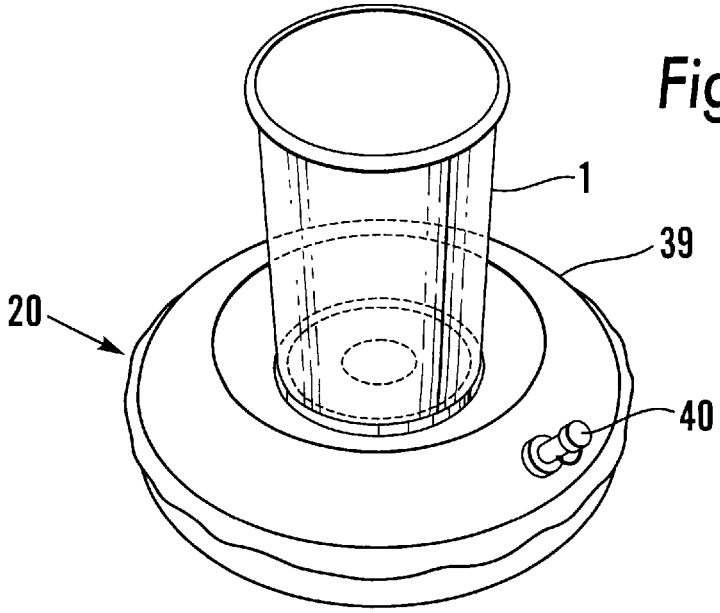

In FIGS. 12*a* and 12*b*, the support 20 comprises an inflatable ring 39 having a valve 40 and shaped with a central cavity 41 having an aperture 42, into which the elongate portion 9 and base 2 of the vessel 1 are inserted. The inflated ring can then be floated on water.

Figure 13:
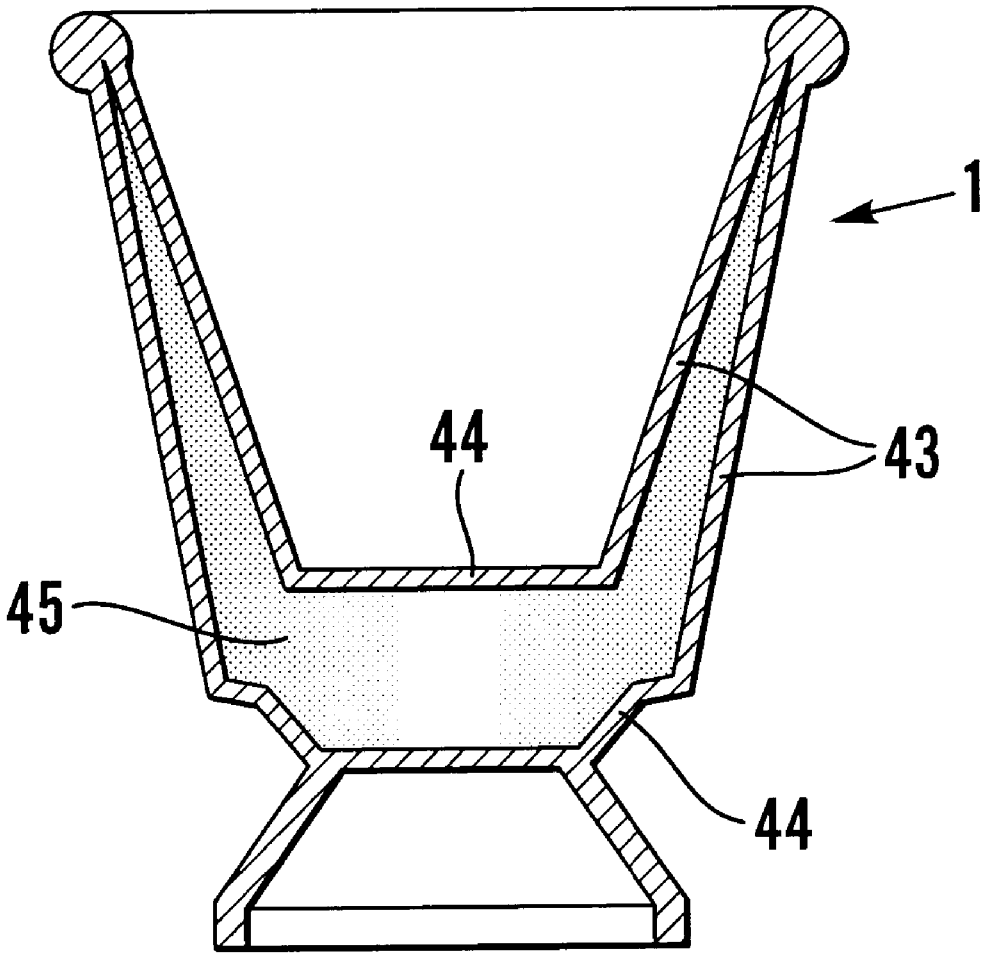
FIG. 13 shows a sectional view of another embodiment of a utensil to which the invention can be applied.

FIG. 13 shows another embodiment of a vessel or other container which can be used with a stability device (not shown) in accordance with the present invention. The vessel 1 has doubled-walled sides 43 and base 44 forming a cavity within which a coolant 45 is permanently contained. The coolant 45 may be a cooling gel, liquid, agent or any other suitable means by which the contents of the vessel can remain cool for a period of time.

The components of the stabilising device and the support may be made from plastics material, such as ABS, polypropylene, etc, or wood, glass metal, rubber or any other suitable material.

Whilst specific embodiments have been described, it will be readily apparent to those skilled in the art that other modifications may be made without departure from the scope of the accompanying claims. For example, the retaining member 4 and the skirt 15 may be integrally formed with the vessel 1 or they may form a separate unit intended to be secured either permanently or temporarily to any suitable utensil. Furthermore, although the utensil has been illustrated as a drinking vessel, it may take the form of, for example, any glassware, jug, flask, plate, dish, candle holder, bowl, or bottle holder. The support may also be in any suitable form for receiving the spigot and providing stability and balance to the utensil. Alternatively, a support may not be used and the spigot can be inserted directly into the ground.

What I claim is:

1. A device for providing stability to a utensil having a surface, said device comprising:

an elongate member including an elongate portion and an end portion, said elongate portion having a longitudinal axis; and a retaining member intended to be provided on the surface of said utensil for detachably retaining said elongate member, said retaining member having means for detachably engaging said end portion of said elongate member whereby the elongate member is in a first position in which the longitudinal axis of said elongate portion is substantially perpendicular to said surface, and for detachably engaging said elongate portion of said elongate member whereby the elongate member is in a second position in which the longitudinal axis of said elongate portion is substantially parallel to said surface.

2. A device as claimed in claim 1, wherein said end portion and said means for detachably engaging said end portion comprise interengageable screw threads.

3. A device as claimed in claim 1, wherein said retaining member has at least one wall and said means for detachably engaging said elongate portion comprises at least one aperture formed in said at least one wall.

4. A device as claimed in claim 1, wherein said means for detachably engaging said end portion and said elongate portion comprises a channel into which said end portion slideably engages when said elongate member is in said first position and into which said elongate portion slideably engages when said elongate member is in said second position.

5. A device as claimed in claim 1, wherein said retaining member is surrounded by a skirt within which said elongate member is contained when in said second position.

6. An assembly for providing stability to a utensil having a surface, said assembly comprising:

a device comprising an elongate member including an elongate portion and an end portion, said elongate portion having a longitudinal axis, and a retaining member intended to be provided on the surface of said utensil for detachably retaining said elongate member, said retaining member having means for detachably engaging said end portion of said elongate member whereby the elongate member is in a first position in which the longitudinal axis of said elongate portion is substantially perpendicular to said surface, and for detachably engaging said elongate portion of said elongate member whereby the elongate member is in a second position in which the longitudinal axis of said elongate portion is substantially parallel to said surface; and a support having at least one aperture for receiving said elongate portion when in said first position.

7. An assembly for providing stability to a utensil having a surface, said assembly comprising:

a device comprising an elongate member having a longitudinal axis, and a retaining member arranged to be provided on the surface of said utensil and to releasably retain said elongate member, said elongate member being releasably retainable by said retaining member in either one of a first position in which the longitudinal axis of said elongate member is substantially perpendicular to said surface, and a second position in which the longitudinal axis of said elongate member is substantial parallel to said surface; and a support having at least one aperture for receiving said elongate member when in said first position, and means for releasable attachment to either one of a stable surface and object.

8. A utensil comprising a container having at least one side wall and a base defining an interior of said container, said container having:

a device for providing stability thereto, said device comprising an elongate member including an elongate portion and an end portion, said elongate portion having a longitudinal axis, and a retaining member intended to be provided on the surface of said utensil for detachably retaining said elongate member, said retaining member having means for detachably engaging said end portion of said elongate member whereby the elongate member is in a first position in which the longitudinal axis of said elongate portion is substantially perpendicular to said surface, and for detachably engaging said elongate portion of said elongate member whereby the elongate member is in a second position in which the longitudinal axis of said elongate portion is substantially parallel to said surface; and means contained within said at least one side wall and said base for maintaining the interior of said container at a cool temperature.

9. A utensil having a base and a device for providing stability to said utensil provided on said base, said device comprising:

an elongate member including an elongate portion and an end portion, said elongate portion having a longitudinal axis, and a retaining member intended to be provided on the surface of said utensil for detachably retaining said elongate member, said retaining member having means for detachably engaging said end portion of said elongate member whereby the elongate member is in a first position in which the longitudinal axis of said elongate portion is substantially perpendicular to said surface, and for detachably engaging said elongate portion of said elongate member whereby the elongate member is in a second position in which the longitudinal axis of said elongate portion is substantially parallel to said surface; and a skirt depending from said base and surrounding said retaining member and within which said elongate member is contained in said second position.

* * * * *